US005082128A

United States Patent [19]

Franzen et al.

[11] Patent Number: 5,082,128

[45] Date of Patent: Jan. 21, 1992

[54] CRANE HAVING A MULTI-SECTION BOOM

[75] Inventors: Hermann Franzen, Mönchen-Gladbach; Walter Köllner, Korschenbroich; Dieter Klessinger, Düsseldorf; Joachim Kröll, Jüchen, all of Fed. Rep. of Germany

[73] Assignee: Mannesmann Aktiengesellschaft, Düsseldorf, Fed. Rep. of Germany

[21] Appl. No.: 453,293

[22] Filed: Dec. 19, 1989

[30] Foreign Application Priority Data

Dec. 19, 1988 [DE] Fed. Rep. of Germany ..... 3842726

[51] Int. Cl.[5] ..... B66C 23/26

[52] U.S. Cl. ..... 212/266; 403/353; 52/726

[58] Field of Search ..... 212/175, 177, 182, 183, 212/187, 188, 266; 403/206, 353; 52/116, 117, 646, 726

[56] References Cited

U.S. PATENT DOCUMENTS

| | | | |
|---|---|---|---|
| 534,507 | 2/1895 | Hoagland | 403/353 |
| 608,000 | 7/1898 | Leatherman et al. | 403/353 |
| 1,807,782 | 6/1931 | Fuchs | 403/353 |
| 1,868,508 | 7/1932 | Stewart | 403/353 |
| 1,941,952 | 1/1934 | Nickles | 212/177 |
| 2,115,194 | 4/1938 | Burton | 403/353 |
| 2,446,410 | 8/1948 | Couse | 212/266 |
| 3,080,068 | 3/1963 | Felkner | 212/177 |
| 3,323,660 | 6/1967 | Allin, Sr. | 212/144 |
| 3,511,388 | 5/1970 | Markwardt | 212/144 |
| 4,316,548 | 2/1982 | Helm et al. | 212/196 |
| 4,358,021 | 11/1982 | Helm et al. | 212/195 |
| 4,601,402 | 7/1986 | Helm et al. | 212/195 |
| 4,711,358 | 12/1987 | Konishi | 212/178 |
| 4,712,697 | 12/1987 | McGowan | 212/266 |

FOREIGN PATENT DOCUMENTS

| | | | |
|---|---|---|---|
| 2421456 | 11/1975 | Fed. Rep. of Germany | 212/188 |
| 3706301 | 10/1987 | Fed. Rep. of Germany . | |
| 465807 | 1/1969 | Switzerland | 212/177 |
| 542713 | 2/1977 | U.S.S.R. | 212/177 |
| 1193544 | 6/1970 | United Kingdom | 212/266 |

OTHER PUBLICATIONS

WO81/02036, International publication.

*Primary Examiner*—Joseph F. Peters, Jr.
*Assistant Examiner*—R. B. Johnson
*Attorney, Agent, or Firm*—Nils H. Ljungman & Associates

[57] ABSTRACT

Cranes having multisection booms have an apparatus for interconnecting boom sections mounted at the ends of the boom sections. The apparatus for interconnecting the boom sections has: on a first boom section, an upper hook member with its concave portion being concave inwardly towards a central longitudinal axis of the boom section; on a second boom section, an upper fork member, having a pair of extending flange portions supporting a bolt member for being received within the upper hook member during interconnection; upper abutment surfaces, which are planar and are perpendicular to the central longitudinal axis of the boom sections, and which are located on the end of the upper hook member and between the pair of flanges of the upper fork member; and a lower strap member on a first boom section for being disposed within a lower fork member on a second boom section during interconnection.

1 Claim, 14 Drawing Sheets

CRANE HAVING A MULTI-SECTION BOOM

BACKGROUND OF THE INVENTION

1. Field of the Invention

This invention relates to a crane having a boom with multi-section, bolted connections and, more specifically, to such connections for crane boom parts having a lattice structure.

2. Description of the Prior Art

There have heretofore been numerous types of cranes having multi-section booms in which the sections are connected to provide the overall assembly of the boom.

Bolted connections, such as those disclosed in German Patent No. 37 06 301, have heretofore been used, among other things, to connect boom joints which are, in particular, the joints of lattice boom parts. They may include so-called bolt joints which are welded onto the boom tubes. The connections are generally three-piece configurations and include a fork, a strap and a bolt.

During the assembly of the boom parts or joints, initially, all the fork-shaped parts must be placed in contact with the corresponding strap with their respective holes in alignment. A bolt or pin member is then inserted or hammered into the aligned holes. At each connection point or location, there are four of these three-piece connections with two of them being in the upper flange and two of them being in the lower flange.

It has been found that manual assembly of these types of connections is very time-consuming. It is particularly noteworthy that, because of the considerable weight of the boom parts, it is quite difficult to bring the holes into alignment for the insertion of the bolts or pin members. In particular, the fourth or last bolt can frequently only be inserted or hammered in with a great deal of force. To some extent, this occurs because of the manufacturing and assembly tolerances for the forks and straps and for the parts to be connected, such as the boom joints. However, it also occurs because, in the vertical longitudinal plane of the boom, there are two degrees of freedom of movement for the joints during assembly. Only the fastening or bolt extends in a transverse direction relative to the longitudinal axis of the boom. Because of the shape of the fork and the strap, the fastening or bolt must be introduced into the "eyelet" of the fork-shaped piece. In the vertical longitudinal plane of the boom, the aligned position for receipt of the fastening or bolt must be achieved manually.

Moreover, the bolts in the upper flange plane can generally be reached only by means of an elevator or the like, which further increases the expense of the assembly process.

Other such multi-section booms for cranes, shovels or the like are disclosed in U.S. Pat. Nos. 3,323,660; 3,511,388; 4,316,548; 4,358,021; 4,601,402; and 4,711,358. These booms are extremely long, to extend as much as several hundred feet, and have transverse widths, which are perpendicular to the length, which may be several stories high when the booms are disposed to extend generally horizontally.

OBJECT OF THE INVENTION

The object of the invention is therefore to improve a multi-section bolt connection of the type generally described above, so that it can not only be installed more rapidly but also more securely, in a manner which facilitates the insertion or hammering of the bolts.

SUMMARY OF THE INVENTION

The objective, which is the basis of the invention, is to limit the free mobility in the vertical boom longitudinal plane, i.e. to limit the above-mentioned two degrees of freedom of movement. This objective is provided, according to the invention, by the use of at least one pair of stops. The preferred strap is almost force-fitted in the fork in a plane which extends perpendicular to the axis of the hole in the fork and is disposed against a stop so that the holes of the fork and the strap are aligned, and the bolts can be inserted with little or no difficulty.

The self-centering limitation of one degree of freedom of movement is provided, according to the invention, by means of at least one pair of stops. In one preferred embodiment, there is provided at least one hook-shaped stop and at least one hook stop. In an additional embodiment of the invention, a pair of stops having a hook-shaped stop includes a thrust block or a counter pressure surface corresponding to the hook. The hook-shaped stop or the hook may be on the strap side of the connection, while the thrust block or counter pressure surface corresponding to the hook may be on the fork side. The hook and thrust block or counter pressure surface, in an additional embodiment of the invention, can also be integrated into the strap or fork piece. In each of the embodiments, the arrangement of the pair of stops or stop pair, according to the invention, achieves a precise fixing of the connection point of the boom parts to be connected.

If the stop pair or pairs are located in the upper flange plane, the assembly time can also be optimized by the elimination of the above-mentioned elevator which is generally necessary to reach the bolts in the upper flange plane. There are preferably two stop pairs in the upper flange plane of each boom joint.

An even better fixing or locating of the connection point can be achieved if, in addition, there is at least one stop pair (surface stop) consisting of two plane surfaces, so that, in a preferred embodiment, two hook stops in the upper flange plane and two surface stops in the lower flange plane of each boom joint to facilitate easy assembly and disassembly. With the hook stops preferably located in the upper flange plane in each of the two corners of the upper flange plane to be connected, i.e. on the end of the flange tubes to be connected, the lattice parts can be very easily brought into the position to guarantee alignment of the holes for the bolts to be installed, by first engaging the hook stops. Because of the hook-shaped configuration of the straps, the bolts or pins are already introduced into the corresponding forks before assembly. In other words, they only need to be "hooked" to the upper flange plane. As soon as this is done, the bolt connection in the upper flange plane can be automatically made, because, with the "hooking" to the upper flange plane, the vertical degree of freedom is limited. As a result, the holes to be aligned in the lower flange plane are located on one and the same circular arc around the bolt of the bolt connection of the upper flange plane disposed vertically thereabove.

In a preferred connection, in which there are two flange stops in the lower flange plane, the third degree of freedom is finally limited by the flange stops. As a result, in the straight, aligned position of the lattice parts to be connected, the surfaces on the fork and the corresponding surfaces on the strap forming the surface stop lie in the lower flange plane and in a proper relationship to one another so that the bolt can be easily inserted or need only be lightly tapped in.

Of course, it is also possible to have only hook stops in both flange planes, so that during assembly, practically all that is done is a "hooking together" of the lattice tower parts to be connected.

To optimize the fabrication processes, it is appropriate to locate the hook or hooks of each pair of stops on the corresponding strap or, in a preferred embodiment, to shape them from the strap, so that the strap itself forms the hook instead of requiring a hole closed on all sides. Preferably, the one surface of each surface stop is formed by a beveled end on the strap and the other surface of the surface stop is located in the base of the fork.

For the optimum transmission of force at the connection points of the lattice tower parts by means of the multi-piece bolted connection, and to be able to absorb and transmit compression forces at these connection points, the preferred hook or hooks of each stop pair are deformed on the end into a stop pressure surface which, when assembled, preferably runs essentially vertically and is in plane contact with the counterpressure surface in the base of the fork.

An additional improvement in the transmission of pressure forces in the upper flange plane can be achieved if the flat counter pressure surface makes a transition away from the center of the boom into a concave surface to provide an external contour of which matches the hook corresponding to it. When assembled, the concave surface should be in close contact with the external surface of the end of the hook with the opening of the hook pointing away from the center of the boom.

To guarantee a secure connection with good force transmission characteristics, the hooks, when the joint is assembled, should extend between 90 degrees and 180 degrees around the corresponding bolts. Preferably, the portion extending around the bolt should be on the side facing the counter-pressure surface. When located in the upper flange plane, they should extend to above the horizontal diameter of the bolt, and, when located in the lower flange plane, they should extend to below the horizontal diameter.

BRIEF DESCRIPTION OF THE DRAWINGS

The invention is explained in greater detail below with reference to the accompanying drawings, which illustrate various preferred embodiments.

DESCRIPTION OF PREFERRED EMBODIMENT

Figure 1:
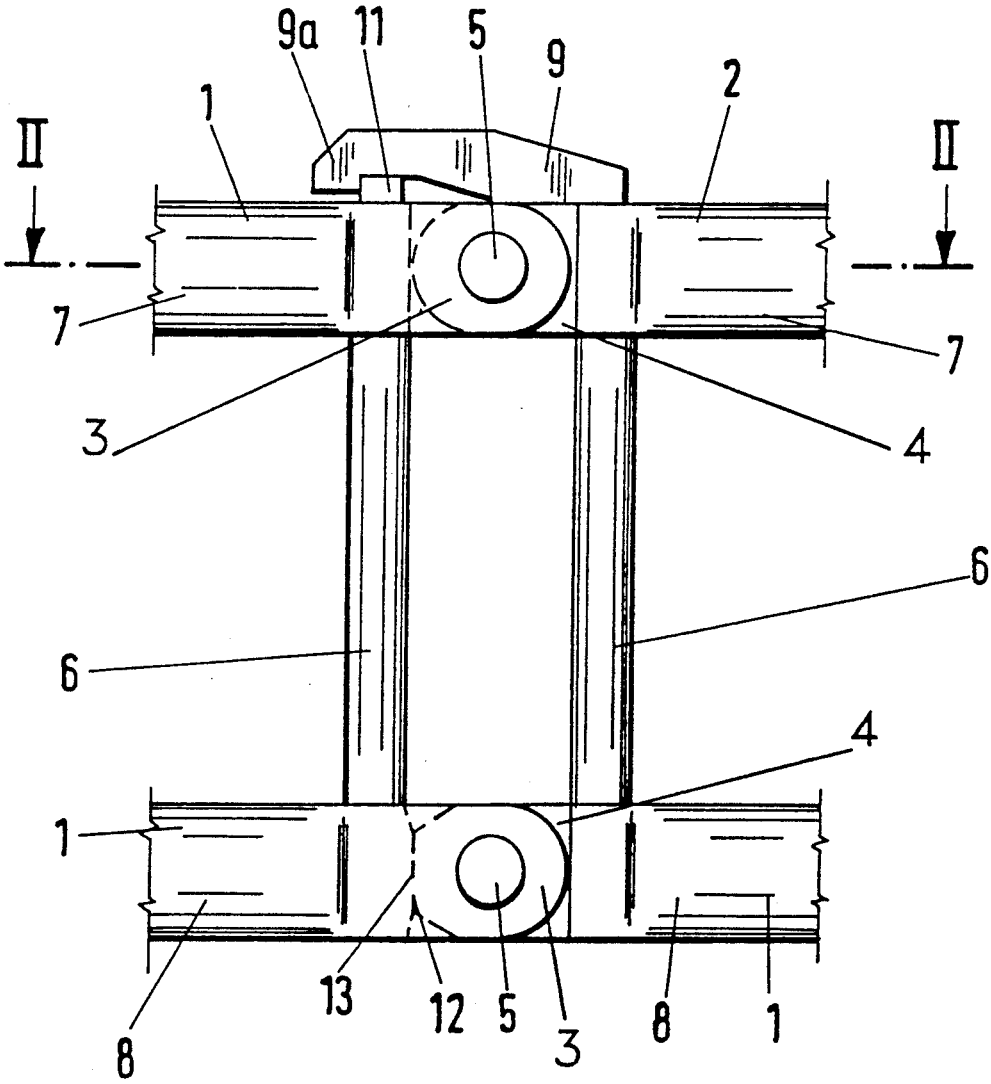
FIG. 1 is a schematic side view of a typical crane which may include boom joints of the type shown for the various embodiments of the invention.
Figure 1A:
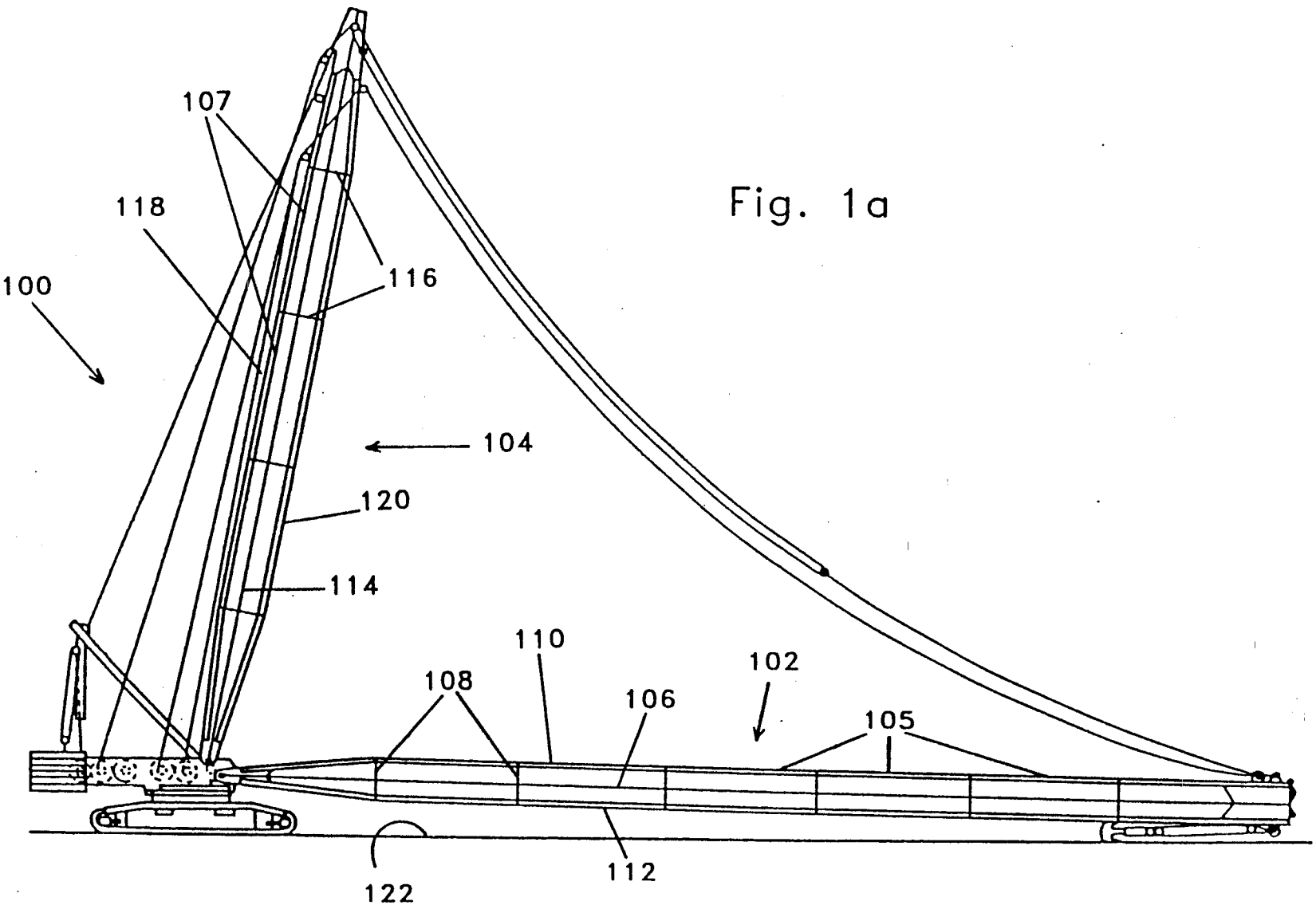
FIG. 1*a* shows a fragmentary side view of a preferred bolted connection, according to the invention, including the ends of two boom joints to be connected.

As seen in FIG. 1*a*, a typical crane 100 may include a first elongated boom 102 and a second elongated boom 104. The first elongated boom 102 is formed of a plurality of sections 105. The elongated boom 102 includes a central longitudinal axis 106 to define a plurality of joints 108 of the sections 105 which are generally disposed in planes transverse to the longitudinal axis 106. Each section 105 includes a plurality of elongated members of a type which will be described in detail hereinbelow. It should be noted that, for the purposes of assembly and for a general understanding of the invention, it is appropriate because the boom 102 is position to extend generally horizontally for assembly. In such a position, the plurality of elongated members include upper members 110 and lower members 112.

Similarly, the boom 104 includes a plurality of sections 107 and has a central longitudinal axis 114. Again, the sections 107 include joints 116 for the joining of the sections 107 which generally lie in transverse planes which are parallel to the longitudinal axis 114. Although, the boom 104 is shown to extend generally vertically again, for the purposes of explanation, each of the sections 107 includes a plurality of elongated members including upper members 118 and lower members 120.

With the booms 102 and 104 being as long as several hundred feet, it should be clear that with either boom 102 or 104 disposed in a generally horizontal position, the upper members 110 or 118 could be several stories above the ground level 122. Having a height which exceeds 20 or 30 feet generally requires an elevated support for the operator to connect the joints between the sections at the upper members 110 or 118.

Figure 10A:
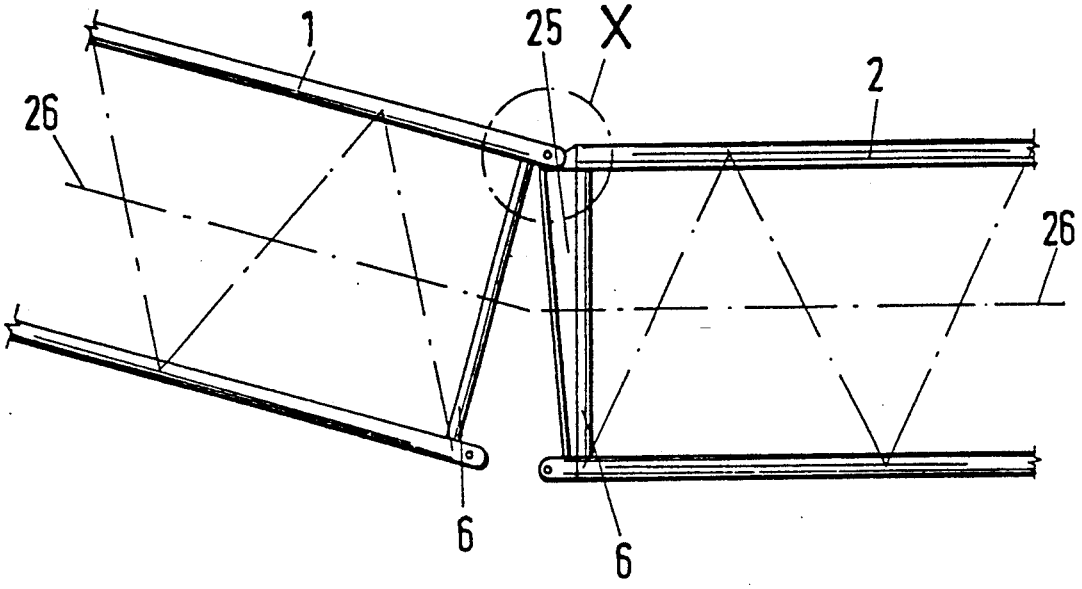
FIG. 10*a* shows a fragmentary side view of two boom joint ends when they are being hooked together.
Figure 11A:
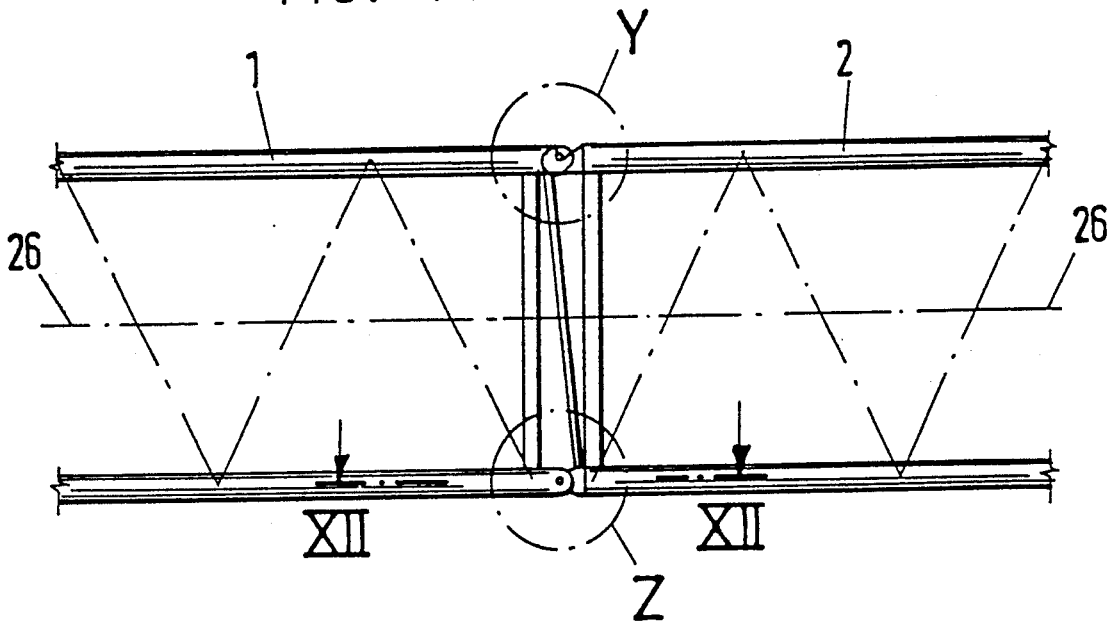
FIG. 11*a* shows a fragmentary side view of the assembled, permanently connected boom parts of FIG. 10*a* in their final aligned position.

From the discussion provided hereinabove, it will be seen that various embodiments of the invention are shown schematically in the figures and are not drawn to scale in order to provide sufficient details to the connecting components while still being able to show how they relate to each other. For example, the connecting transverse members 6 of FIGS. 1, 2, 3, 6, 7, 8, 9, 12*a*, 12*b*, and 12*c* clearly appear to be shorter than would actually occur for a large crane or boom structure of the present invention. Although the embodiments in FIGS. 10*a* and 11*a* are also shown schematically, the scale shown therein more accurately represents the relative sizes of the components which may be used to provide such a large crane or boom structure.

Figure 2:
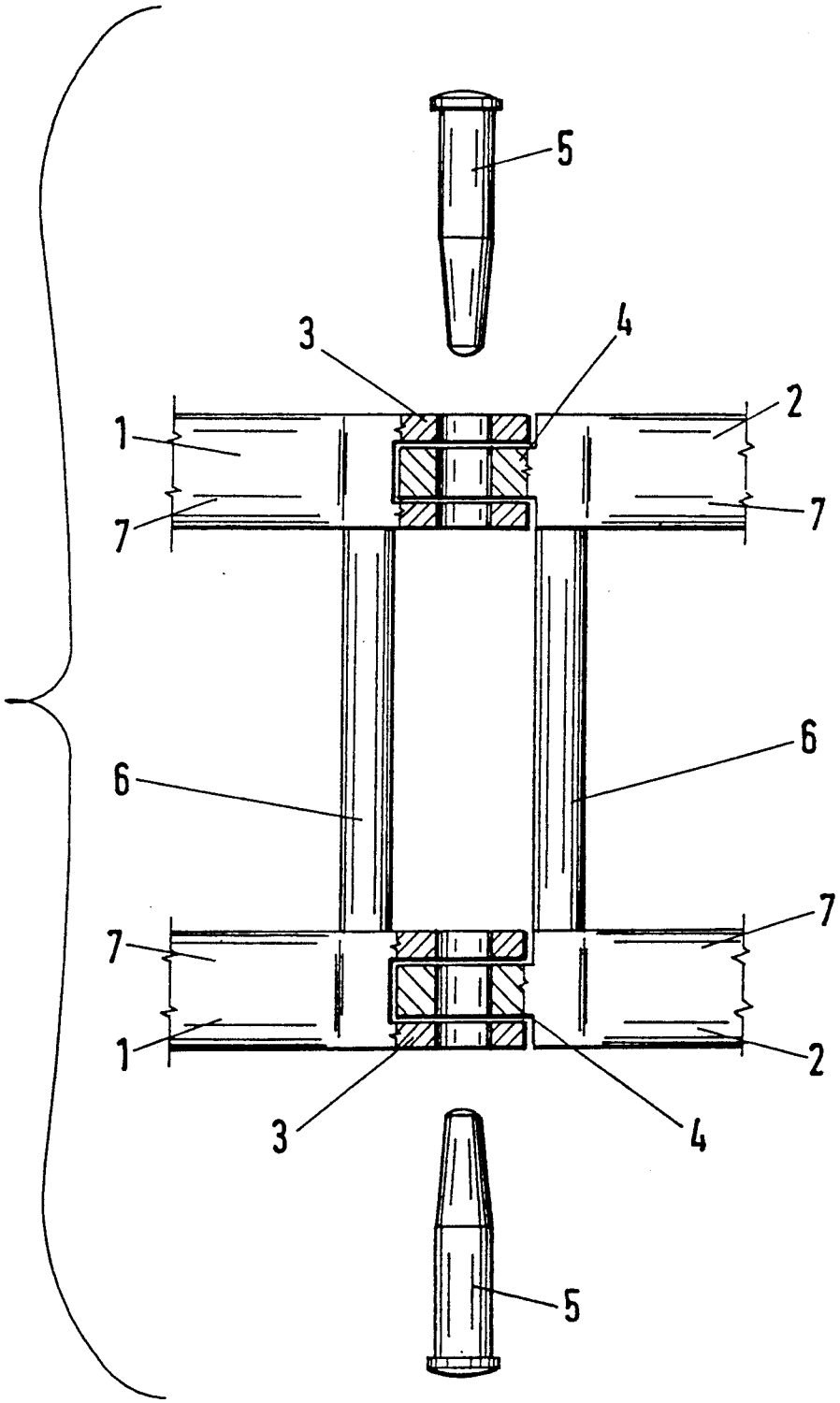
FIG. 2 shows a partial cross section along a portion of line II—II in FIGS. 1 and 3.

Accordingly, FIG. 1 shows a side view of two boom joints 1 and 2, which are connected to one another, with their ends containing a preferred bolted connection. As seen in FIG. 2, which includes a cross sectional view generally along a plane of the upper flange, a first embodiment of the invention consists of standard bolted joints, each comprising one fork element 3 and one strap element 4 which are interconnected. To complete a joint connection, a bolt 5 is required so that, in the illustrated embodiment four of them are employed for joint. Each joint 1 and 2 includes upper flange tubes 7 and lower flange tubes 8 and a plurality of the connecting transverse members 6.

In a conventional screw bolt connection, the four bolts must always be hammered into the holes in the corresponding forks and straps, which must be brought into alignment. It is not uncommon for the bolts to include conventional large dimensions as load-bearing or load-transmitting parts. Some embodiments may include a four-section or multi-section connection instead of the two-section connection shown in FIGS. 1 and 2.

In contrast to the prior art, however, the preferred embodiment shown in FIGS. 1 and 2 has in the upper flange plane a pair of stops which are in the form of a hook stop and a thrust block stop. The hook stop includes a hook 9 welded or otherwise permanently fastened to the upper side of the upper flange tube 7 in the vicinity of the end of the boom joint 2. The free hook-shaped end 9*a* of the hook 9 projects beyond the top of the fork side of the joint 1 and is engaged behind a stop including a thrust block 11 fastened to the top side of each upper flange tube 7 of the boom joint 1.

This embodiment facilitates the introduction of the bolts 5 into the holes in the fork 3 and strap 4 by bringing the two joints or their ends to be connected to one another into a defined position The engagement of the hook 9 and block 11 maintains the ends in position so that the corresponding holes of the fork 3 and the strap 4 are aligned, so that each connecting bolt can be inserted in a manner which is simpler than the manner used in the prior art.

In order for the holes in the lower flange plane to also be aligned without complex manipulation, the preferred embodiment of the invention also includes an additional pair of stops in the vicinity of the lower flange tube. The additional pair of stops include a beveled end or portion 12 of the strap 4 and a counter surface 13 in the base of the fork 3 of the lower flange plane. The counter surface 13 corresponds to the beveled portion 12 and is in planar contact with the portion 12 when assembled. In the stop position, as shown in FIG. 1, the holes of the straps 4 and the forks 3 of the lower flange plane are then aligned and, therefore, facilitate easy installation of the connecting bolts.

Figure 3:
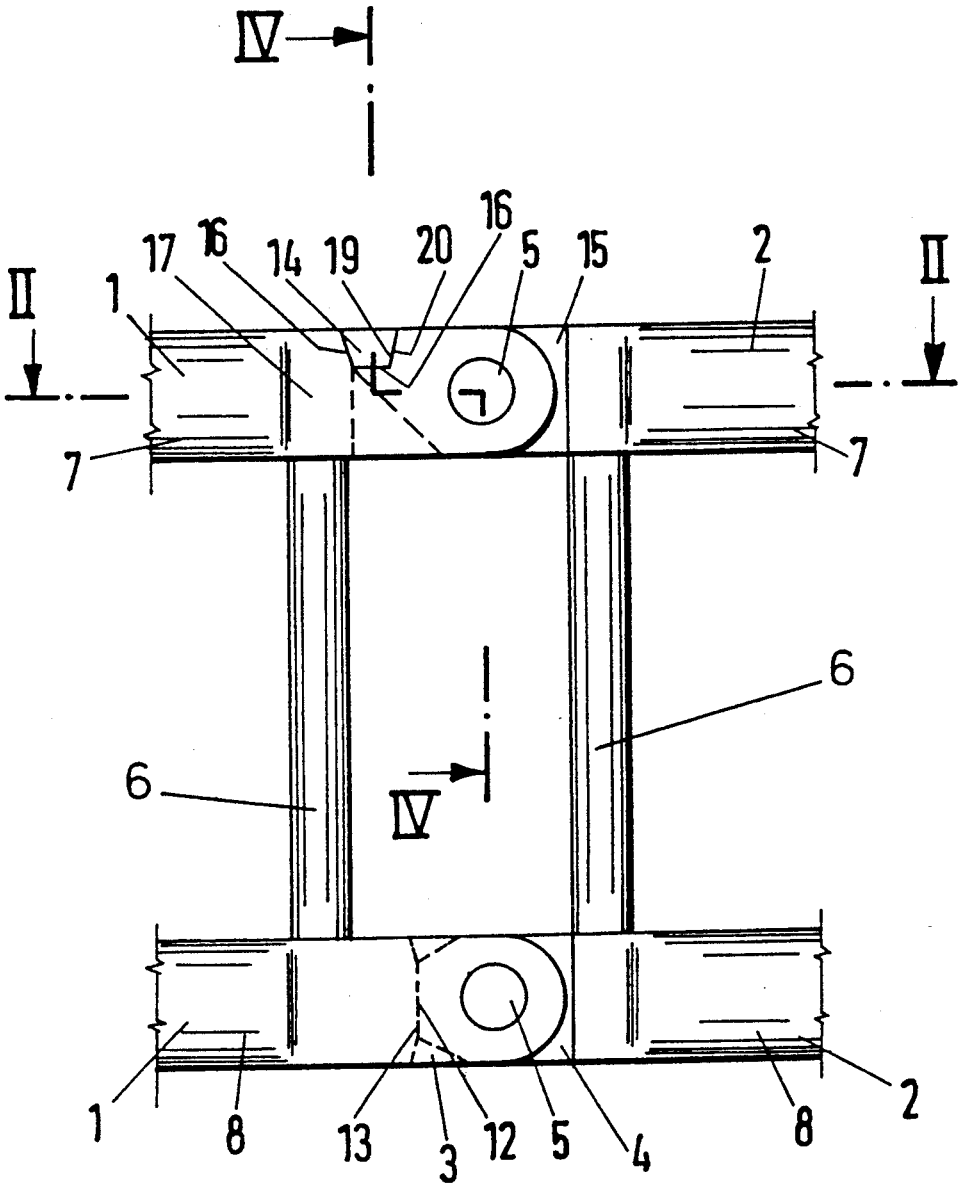
FIG. 3 shows a fragmentary side view, similar to that of FIG. 1, of an alternative embodiment of the invention including, in the upper flange level, a preferred hook integrated into the strap and a thrust block integrated into the fork.
Figure 4:
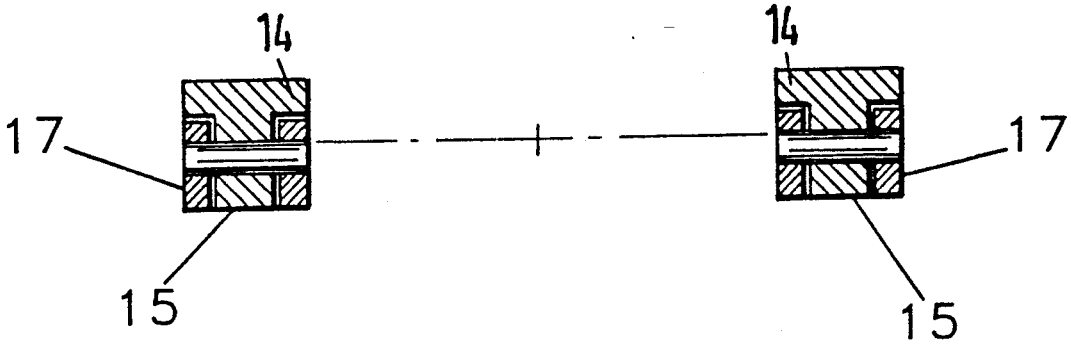
FIG. 4 shows a cross section of FIG. 3 along Line IV—IV.
Figure 5:
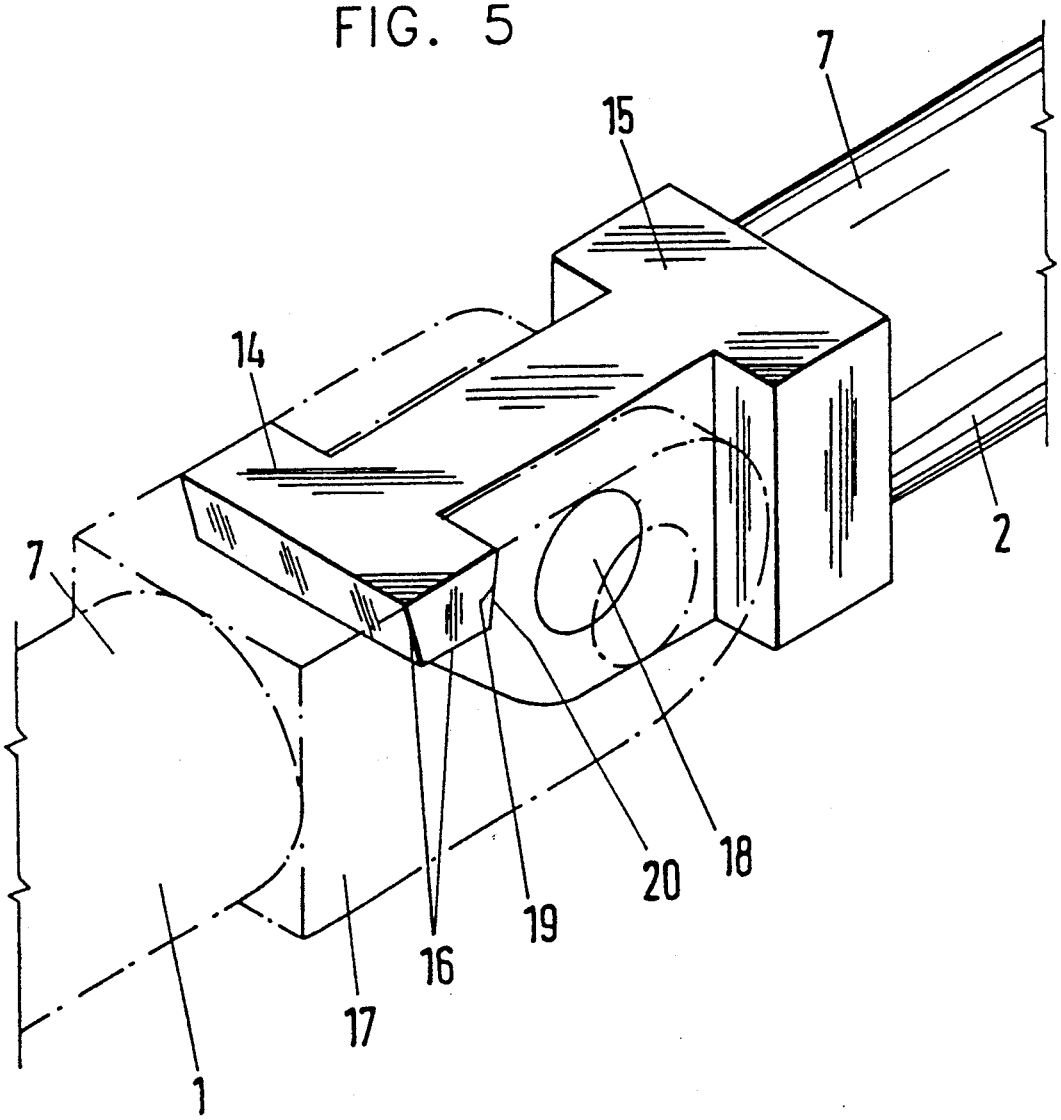
FIG. 5 shows a fragmentary perspective view of the hook stop shown in FIG. 3 for the upper flange plane with the corresponding fork portion shown in phantom.

An alternative embodiment of the connection described above and shown in FIGS. 1 and 2 is illustrated in FIGS. 3 to 5. This embodiment includes a hook and a corresponding thrust block which are intergral with or integrated into the straps and/or forks of the upper flange plane. The preferred hook and thrust block configuration is formed with outer contours which are aligned with the outer contours of the straps and forks and, therefore, do not extend beyond the upper edge of the upper flange tube 7. In particular, such an arrangement tends to prevent damage to the hook stop.

For the embodiment of FIGS. 3 and 4, the lower flange plane is essentially the same as that in the embodiment illustrated in FIGS. 1 and 2. Again, each connection includes a total of two surface stops which cooperate as a stop pair for each lower flange tube 8. There is a surface and a corresponding surface on the corresponding lower flange 8 of the adjacent joint end of the other boom piece. Their relationship is the same as that described hereinabove for the lower flange plane of the embodiment illustrated in FIG. 1.

As mentioned above, in the embodiment of FIGS. 3 and 4, the hook stop in the upper flange plane is incorporated into a conventional bolted connection. Consequently, the component which performs the hooking function consists of an upper, essentially T-shaped extension 14 of the strap 15 connected to the upper flange tube 7 of the boom joint 2 (as best seen in FIG. 5). When the lattice parts are assembled, the terminal section of the T-shaped extension 14 extends perpendicular to the longitudinal axis of the aligned upper flange tubes 7 of the two boom joints 1 and 2 to be assembled. The terminal section of the T-shaped extension 14 fits into a corresponding, upper recess 16 in the base region of the fork 17 (as shown by dotted lines in FIG. 5). To facilitate the insertion of the terminal section of the T-shaped extension 14 into the recess 16, the recess 16 is slightly tapered toward its base. The terminal section of the T-shaped extension has matching, appropriately tapered surfaces. The surface 19 of the terminal section functions as the hook-shaped stop of the strap 15 and faces the holes 18 holding the bolt 5 (not shown in FIG. 5), while the opposing surface 20 of the recess 16 of the fork-shaped piece 17 functions as the thrust block or the counterpressure surface.

As shown in FIG. 5, as a result of this configuration, the top surfaces of the bolted connection are aligned so that there is a smooth surface toward the outside of the upper flange tubes 7. It should also be mentioned that, in the two embodiments of the invention described above, the hook stops are used only to facilitate assembly of the boom pieces. Neither are designed nor intended for the transmission of force during operation of the crane. The tensile and compression forces in the upper flange plan are transmitted, as before, by the bolted joint, but the advantages of the invention for facilitating the assembly are completely and reliably achieved.

In the alternative embodiments shown in FIGS. 6 through 12*c*, however, there are included additional features. In addition to facilitating assembly, these embodiments have the additional advantage of being configured so that, by means of the bolted joint of the upper flange plane, the compression forces in the plane are also transmitted with no load on the bolt, which contrasts to the embodiments described above and illustrated in FIGS. 1 to 5. On the other hand, the tensile forces are transmitted from the hooks employed in these embodiments to the corresponding bolts. In the lower flange plane, as a result of the bevels 12 and the corresponding counter surfaces 13, which are primarily centering aids for the bolts in the lower flange, compression forces are also transmitted in the lower flange plane with no load on the bolts.

Figure 6:
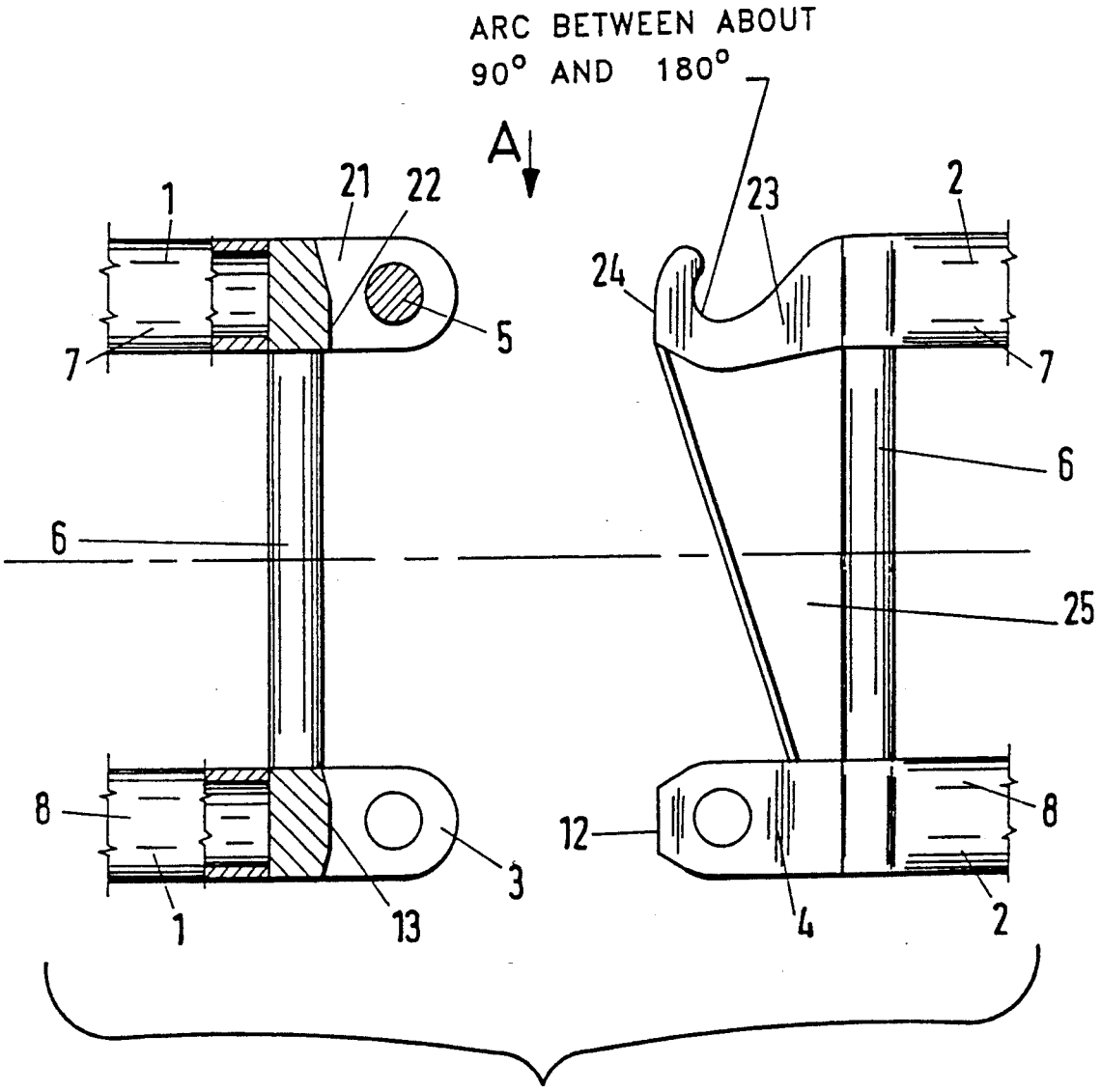
FIG. 6 shows a fragmentary side view of a preferred embodiment of the invention, before assembly, including the two ends of two adjacent boom joints to be joined with a "two-piece" bolted connection.
Figure 7:
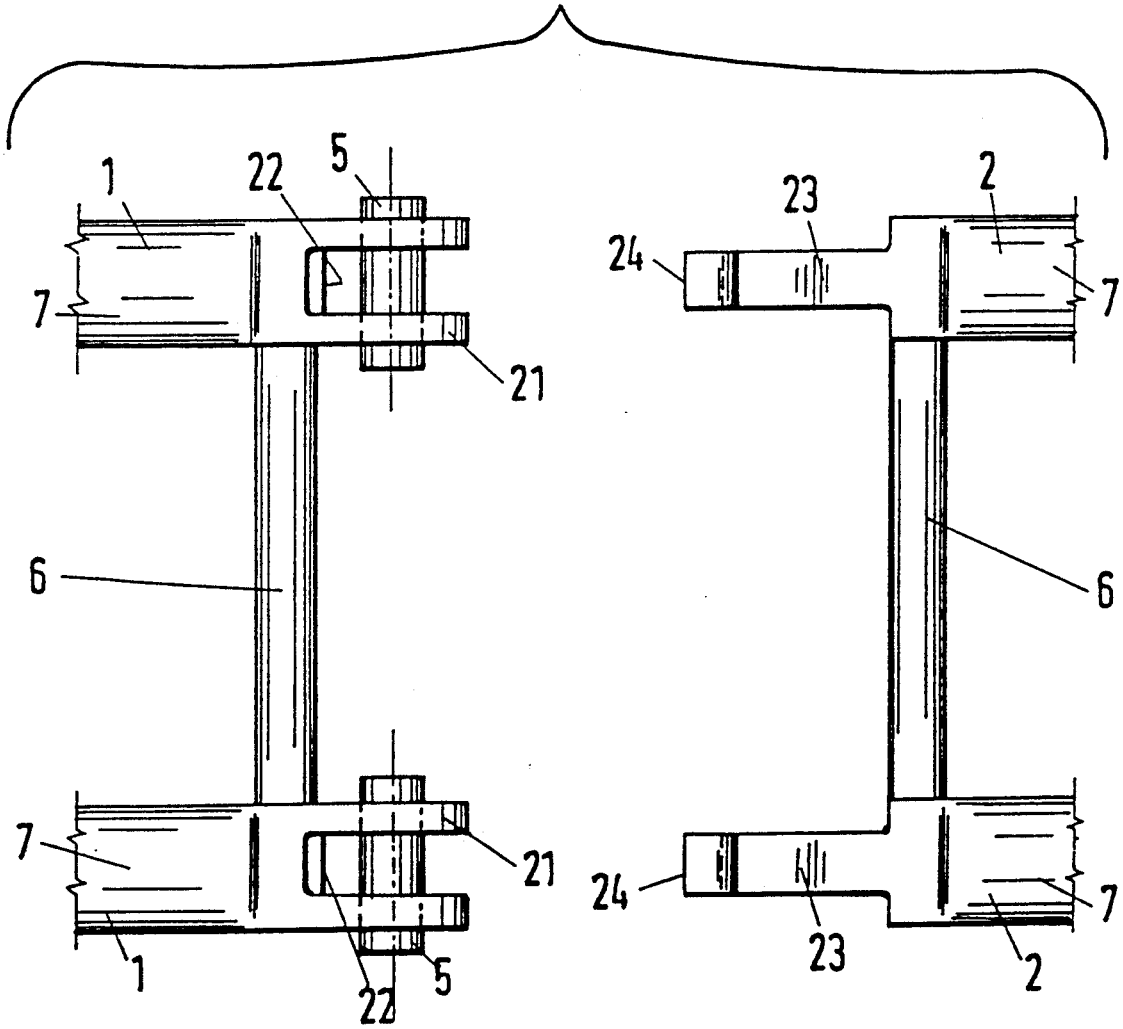
FIG. 7 shows a fragmentary top view of the embodiment of FIG. 6 as viewed in the direction as indicated by the arrow A.

As seen in FIGS. 6 and 7, the two ends of the two boom joints 1 and 2 to be connected are shown before they are joined together. FIG. 6 is a side view of the parts including one of the upper flange tubes 7 and one of the lower flange tubes 8, while FIG. 7 is a top view as seen in the direction of Arrow A in FIG. 6. In this preferred embodiment of the invention, the fork 21 has a counterpressure surface 22 in the vicinity of its base. Each of the two straps of the upper flange plane is in the form of a hook 23 which is open toward the top. The "hole" or opening in the strap or hook 23 which holds the bolt 5 is not closed on all sides to provide a top opening which is at least as wide as the diameter of the bolt 5. On its free end, the hook 23 is shaped into a stop pressure surface 24. The stop pressure surface 24, like the counter pressure surface 22 with which it corresponds when assembled and against which it is pressed flat, is oriented essentially vertically and has dimensions corresponding to the surface 22. From the free end of the hook 23, a reinforcement 25 extends downward and is offset backward toward the lower flange tube 8. The reinforcement 25 serves to absorb the displacement moment in the hook 23 which might occur because of the lack of support in the area of the opening. Additionally, as will be seen, the alignment of the reinforcement 25 with the free end of the hook 23 provides a generally un-obstructed outer surface which can be employed to facilitate alignment of the hook 23 with the fork 21 as the boom joints 1 and 2 are being brought together.

In the lower flange region, the bolted joint is similar to that of the embodiments illustrated in FIGS. 1 to 5. The strap piece 4 has, on its free end, a bevel 12, which also extends essentially vertically and which corresponds to the counter surface 13 in the base of the fork 3. The bevel 12, therefore, represents the stop pressure surface in the lower flange plane, by means of which the bolt is centered in the lower flange plane, by interaction with the corresponding counterpressure surface 13.

Figure 8:
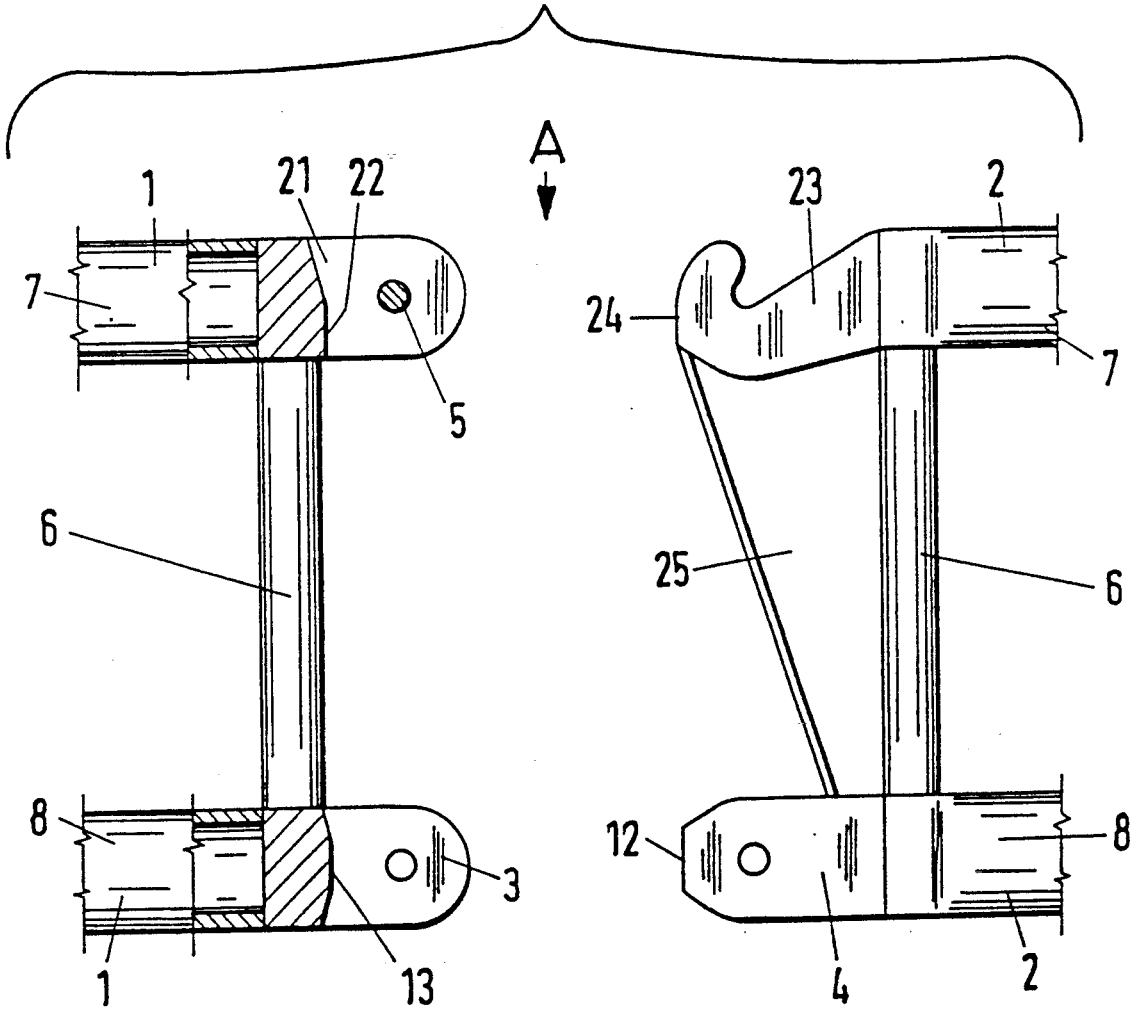
FIG. 8 shows a fragmentary side view of another preferred embodiment of the invention similar to that shown in FIG. 6 before assembly of the boom parts but as a "four-piece" bolted connection.
Figure 9:
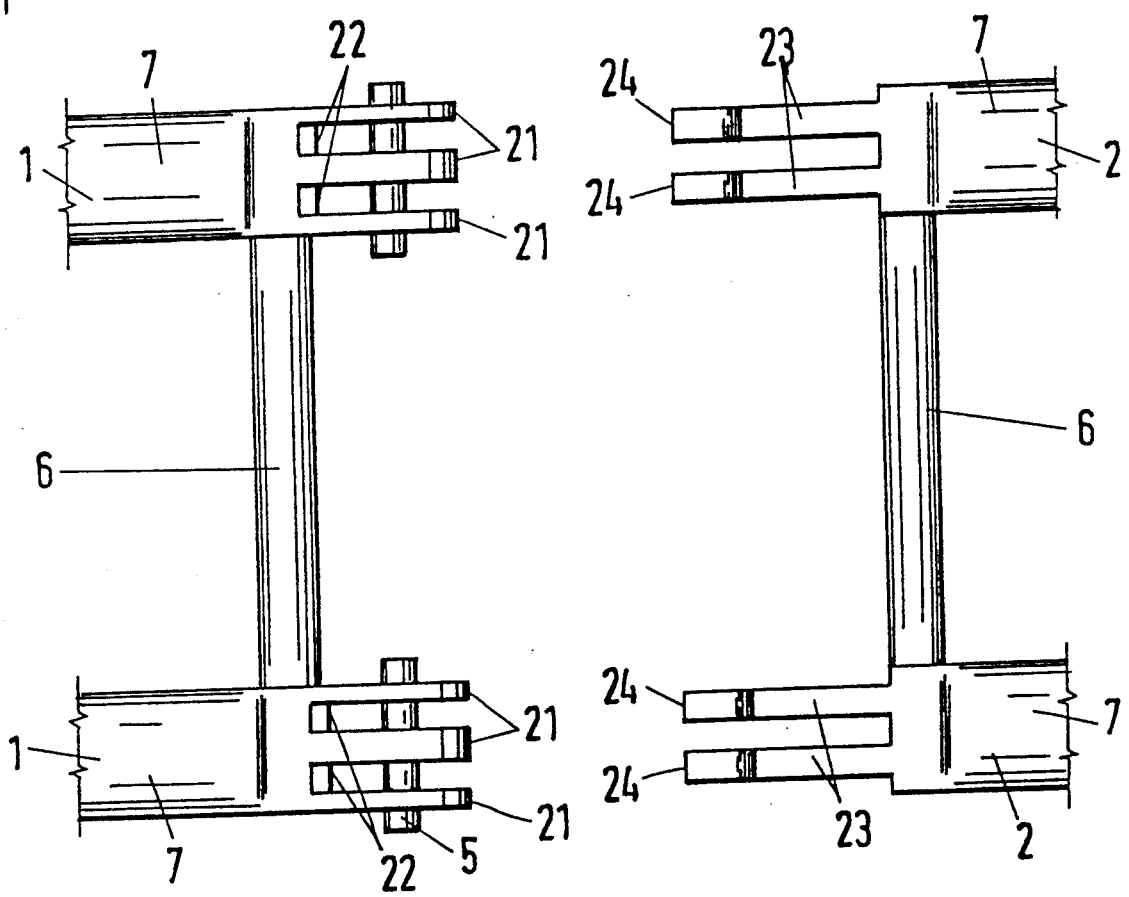
FIG. 9 shows a fragmentary top view of the embodiment FIG. 8 as viewed in the direction as indicated by the arrow A.

In FIGS. 8 and 9, another embodiment of the invention is similar to that described above and shown in FIGS. 6 and 7. However, this embodiment includes a four-section connection. As a result, the diameter of the bolt 5 can be kept smaller than with a two-section connection employed in the embodiment of FIGS. 6 and 7. Instead of there being two interfaces of the bolt 5 subjected to shear strain, there are four so that, ultimately, the overall connection can be significantly smaller. Otherwise, the general configuration of the forks and straps is the same as that in the embodiment of FIGS. 6 and 7. As a result, reference can be made to the preceding descriptions and the corresponding pieces are identified by the same reference numbers. Because of the four-sections of the connection, there are a pair of identical hooks 23 for each upper flange tube 7 in the upper flange plane in the strap element, as shown in FIG. 9. When the boom parts are assembled, these double hooks 23 are engaged with the corresponding double recesses of the corresponding fork 21, with the bolt 5 engaged from behind. Accordingly, there would also be two counterpressure surfaces 22 and 13 and two respectively corresponding stop pressure surfaces 24 and 12 for the embodiment of FIGS. 8 and 9.

Figure 10B:
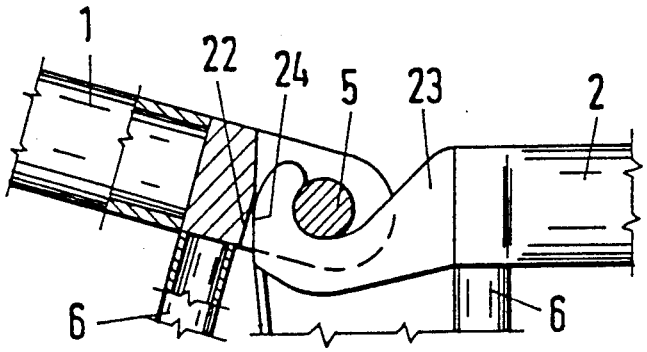
FIG. 10*b* is an enlarged fragmentary view of one embodiment of the invention in the area X of FIG. 10*a*.
Figure 10C:
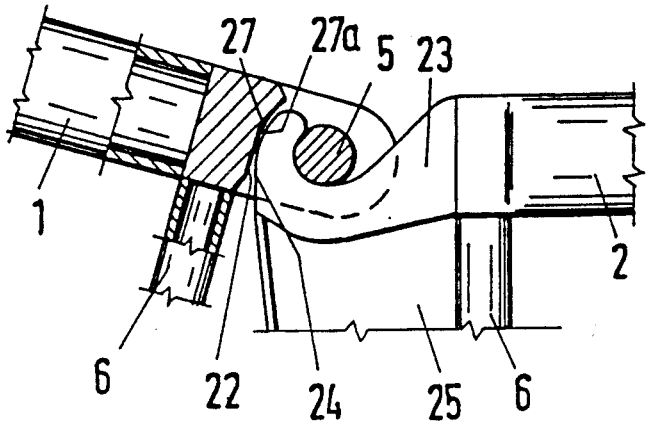
FIG. 10*c* is an enlarged fragmentary view of another embodiment of the invention in the area X of FIG. 10*a*.

As seen in FIG. 10*a*, two boom joints 1 and 2 are in an interim position during the assembly process. FIGS. 10*b* and 10*c* respectively include fragmentary enlarged details of two embodiments of the bolted joint with hook stops according to the invention.

As shown in both FIGS. 10*b* and 10*c*, the boom parts to be joined together are joined along a line perpendicular to the plane of the drawing through the bolted connections on the upper flange plane by means of forks and straps. However, within the plane of the drawing, they are hooked together with their longitudinal axes 26 at an angle to one another so that the hook-shaped straps 23 are capable of engaging the corresponding bolts 5 from below. The hooks 23 are configured for a simple and uncomplicated hooking of the boom part 2 with the boom part 1. In each embodiment, the stop pressure surfaces 24 and the counterpressure surfaces 22 are dispose to provide sufficient displacement for a subsequent angular adjustment until the boom parts or joints are aligned as generally shown in FIG. 11. After the hooking, as shown in FIG. 10*a*, the boom joint 1 is pivoted downwardly around the bolted joint of the upper flange plane until the stop pressure surfaces 12 and the counterpressure surfaces 13 of the lower flange plane are in contact, so that the center longitudinal axes 26 of the two boom joints 1 and 2 are aligned (as generally seen in FIG. 11). After alignment, the bolts in the lower flange plane can be easily inserted in the bolted connection, through the aligned holes of the corresponding fork and strap.

In contrast to the embodiments of FIGS. 1 through 5, there would be no need to hammer in the bolts of the upper flange plane, since they have already been inserted in the pre-assembly stage as a counter element for the hooks into the fork. In addition to the advantages described above, this method has the additional advantage of a fixed assembly orientation which facilitates orientation of the parts, so that there is no need for an elevator to reach the upper flange plane. In addition, the invention has the further advantage that, because of the configuration, the hooking according to the invention can be done automatically and positively, with little or no manual assistance.

Figure 11B:
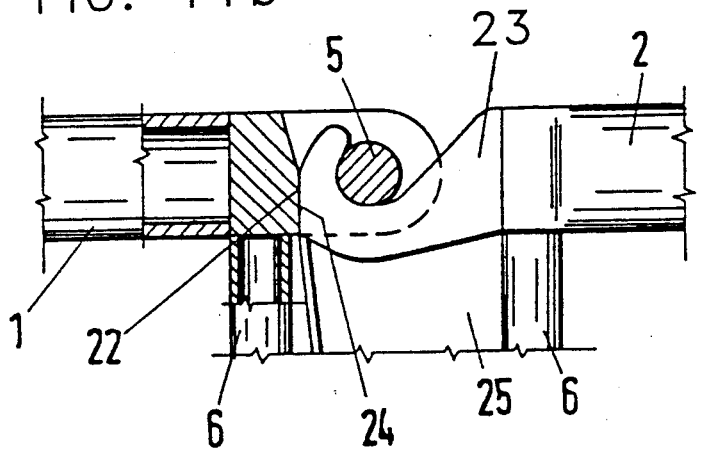
FIG. 11*b* an enlarged fragmentary view of the embodiment of FIG. 11*a* seen in the area Y.

As seen in FIGS. 11*a* and 11*b*, in the assembled state, the stop pressure surfaces 24 of the upper flange plane are in tight contact with the corresponding counterpressure surfaces 22. In addition to fixing the position, the surfaces 22, 24 are also capable of transmitting compression forces which occur in the upper flange plane. Because the hooks 23 are open and toward the top, compression force can not be transmitted to the bolt 5 and is instead transmitted at the above-described surfaces 22, 24.

Figure 11C:
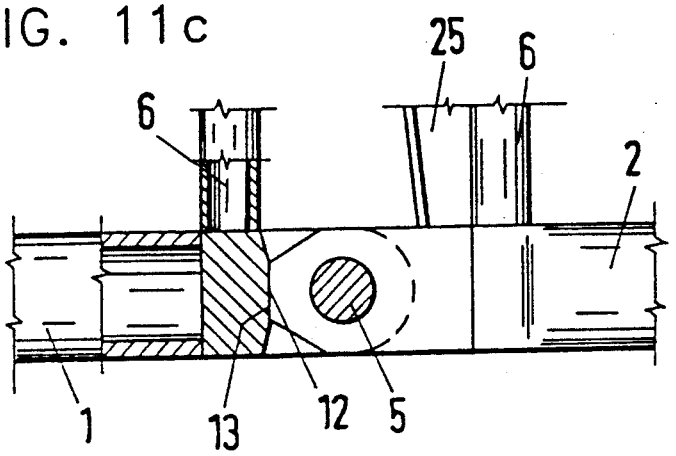
FIG. 11*c* is an enlarged fragmentary view of the embodiment of FIG. 11*a* as seen in the area Z.

In the lower flange plane, as seen in FIG. 11*c*, the corresponding stop pressure surfaces 12 and counterpressure surfaces 13 are also designed as contact blocks. Surfaces 12, 13 are also capable of transmitting compression forces, after they have been used during the assembly process to fix the position and to function as stops for the straight, properly aligned orientation of the boom joints 1 and 2 to be connected.

As seen in FIGS. 10*b* and 10*c*, there are two additional alternative configurations of the counterpressure surfaces 22 in the upper flange side fork. In both cases, the counterpressure surface is a plane in the lower region and has dimensions and an orientation which match the stop pressure surface 24. However, toward the top in the embodiment of FIG. 10*b* relative to the center longitudinal axis of the upper flange tube of the boom joint 1, the base of the fork is shaped diagonally backward, away from the free end.

On the other hand, in the embodiment of FIG. 10*c*, the counterpressure surface 22 makes the transition away from the center of the boom, above the center longitudinal axis of the upper flange tube of the boom joint 1, into a surface 27 which is generally concave. The curvature of the surface 27 matches the outer contour of the corresponding hook 23. When assembled, the surface 27 is in tight contact with the external surface 27*a* of the end of the hook 23. In this manner, an extremely favorable contact situation is achieved by providing a centrally aligned introduction of the pressure forces into the upper flange tube of the joint 1, since the force-transmitting surfaces are in contact with one another both above and below the center longitudinal axis of the upper flange tube.

The embodiments illustrated in FIGS. 6 through 10 have the particular advantage of including a configuration for generally removing the load removed from the bolts. On the one hand, at the upper flange side, stop pressure surfaces 24 contact the counterpressure surfaces 22 and, at the lower flange side, the surfaces 12 contact the surfaces 13 to transmit forces so that the load is removed from the bolts under these operating conditions. To this extent, the stop pressure surfaces and counterpressure surfaces act to provide additional security and, in particular, to relieve the bolts if compression forces are introduced and then transmitted by the surfaces.

Figure 12A:
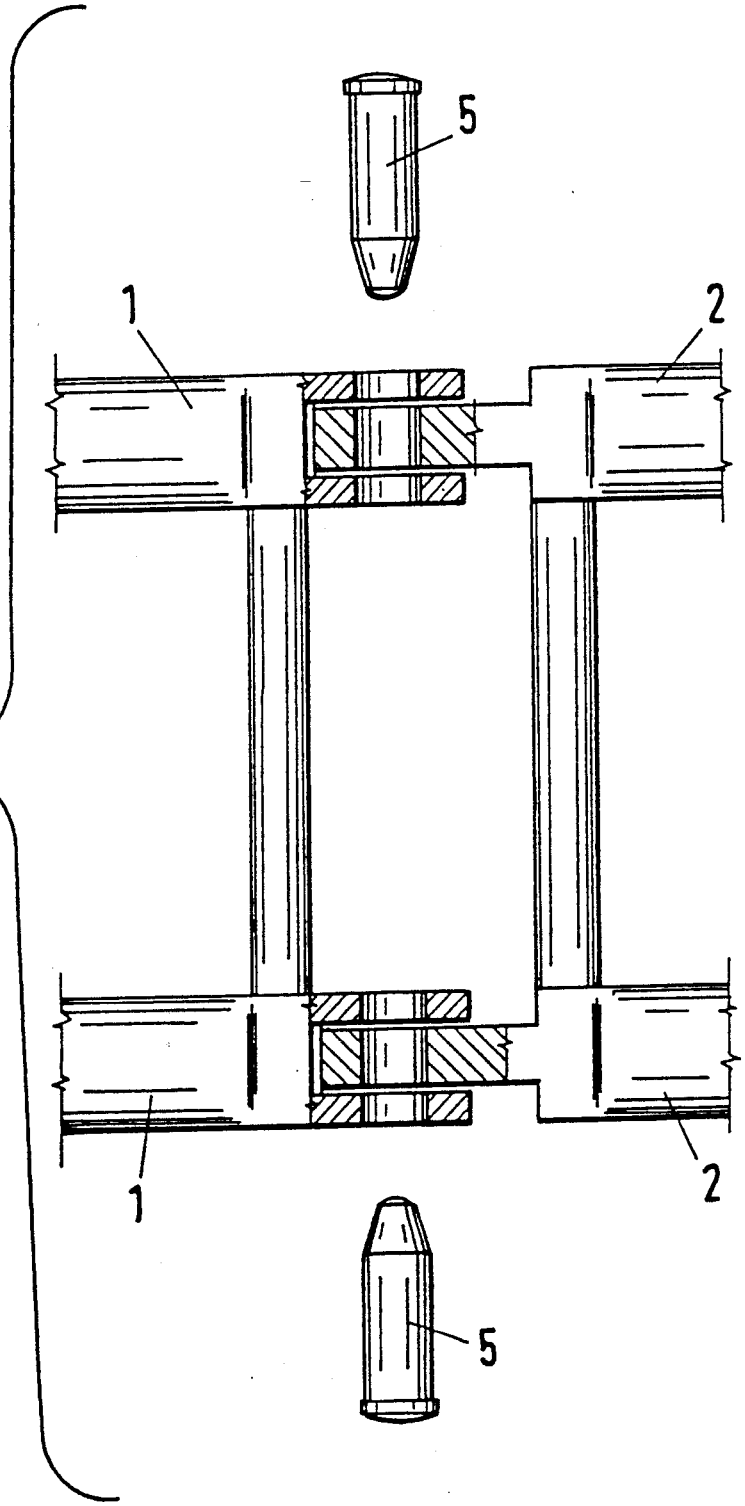
FIGS. 12*a* to is a fragmentary view, as generally seen along Line XII—XII in FIG. 11*a*, to illustrate a preferred connection for the lower flange plane.
Figure 12B:
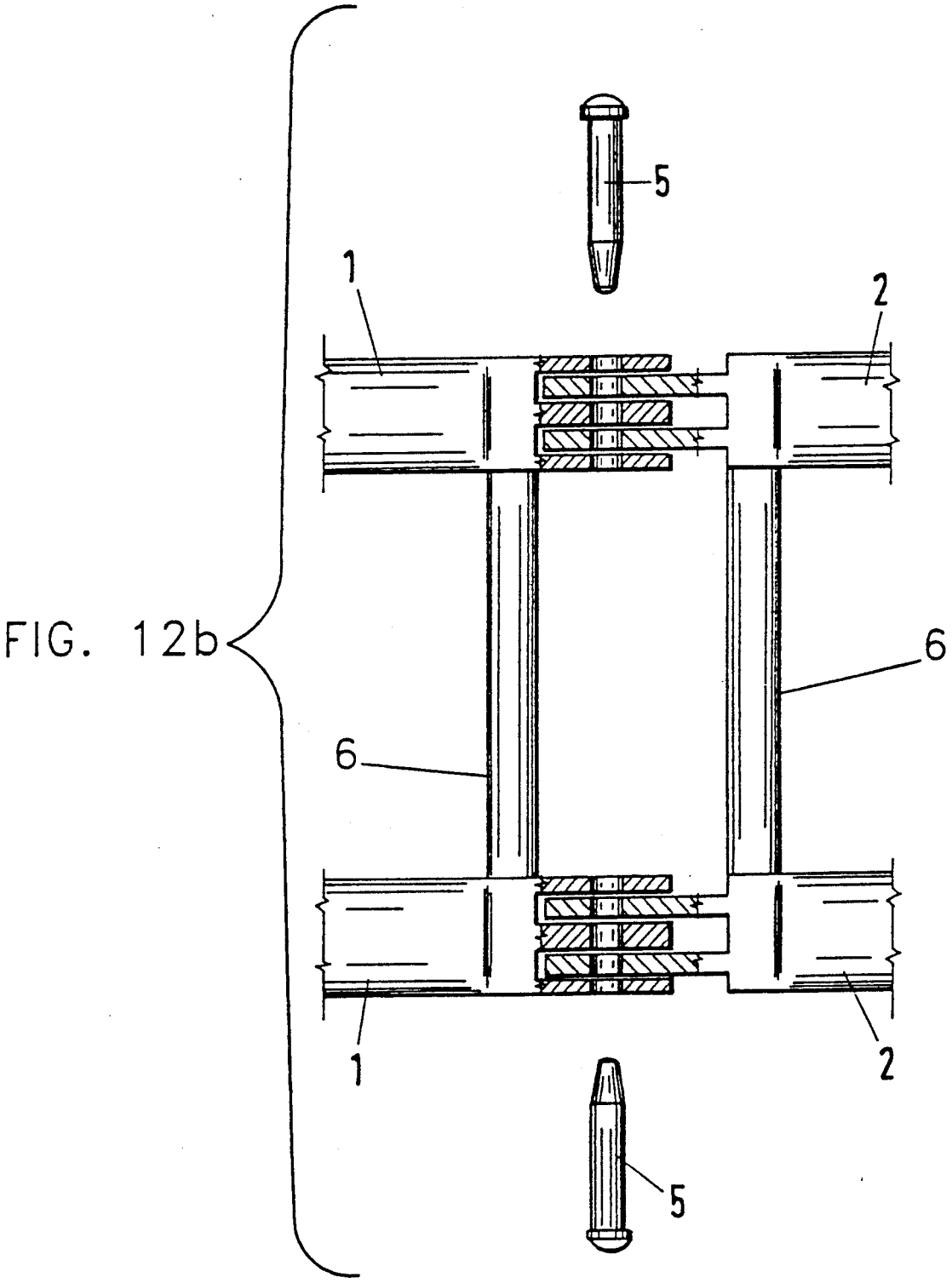
FIG. 12*b* to is a fragmentary view, as generally seen along Line XII—XII in FIG. 11*a*, to illustrate another preferred connection for the lower flange plane.
Figure 12C:
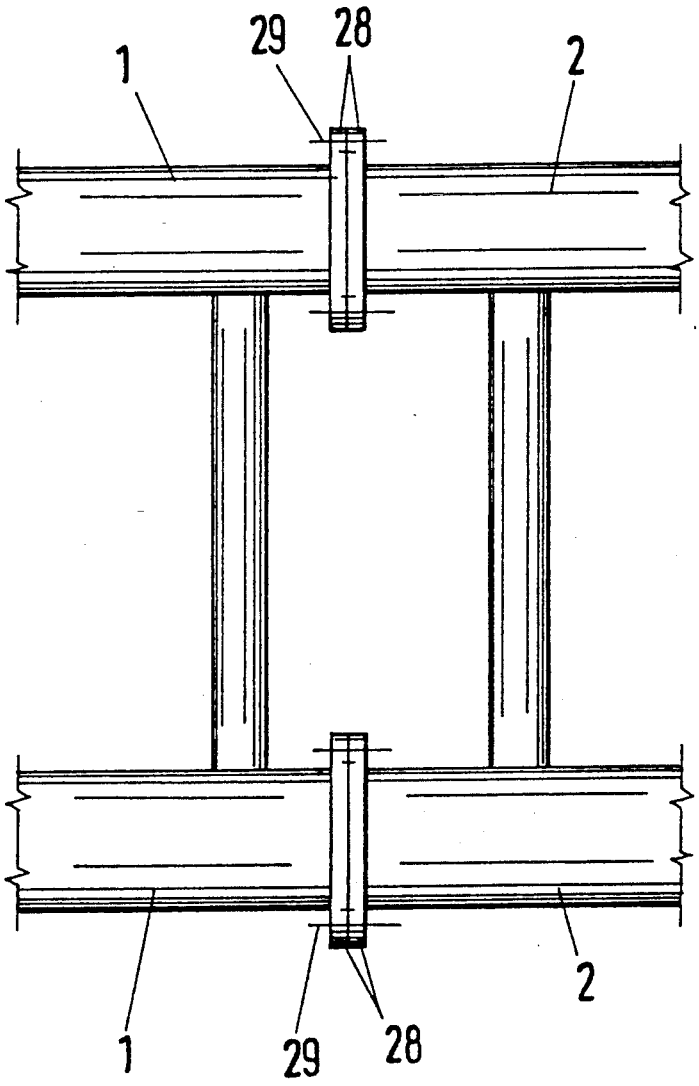
FIG. 12*c* to is a fragmentary view, as generally seen along Line XII—XII in FIG. 11*a*, to illustrate yet another preferred connection for the lower flange plane.

Modifications and variations are possible within the context of the invention. For example, the various stop pairs can be installed or combined in different shapes and numbers, as a function of the particular requirements. For example, for the lower flange plane, with basically hook-shaped bolt connections in the upper flange plane, the embodiments illustrated, by way of example, in FIGS. 12*a* to 12*c* are possible. As shown in FIG. 12*a*, the lower flange plane can be formed in two sections with correspondingly-sized bolts 5. A four-section screw bolt joint, as shown in FIG. 12*b*, makes possible a reduction of the diameter of the bolt 5. As an alternative to the embodiments illustrated in FIGS. 12*a* and 12*b*, there can also be a flange connection in the lower flange plane, as illustrated in FIG. 12*c*. In such a case, the joints 1 and 2 to be connected to one another are provided on their facing ends with corresponding flanges 28, which are to be connected by means of screws 29. During assembly, the flanges 28 would serve as stops with their exposed, facing contact surfaces. Still further, with an appropriate configuration, the flanges 28 can also perform assembly guidance and positioning functions similar to the forks and straps according to the invention. During operation, the flanges 28 would be then capable of transmitting both compression and tensile forces.

It should be noted the embodiments described hereinabove include lattice structures with four parallel tubes which have joints or junction areas in a generally common plane perpendicular to the tubes. Some alternative embodiments could include an array of three or more tubes which are parallel or slightly converging. Still further, all the specific joints need not lie in a common plane but may alternatively be disposed in several parallel planes which are each generally parallel to the transverse plane described hereinabove and perpendicular to the array of tubes. Such a staggered configuration of joints could cooperate to function in the same manner as described hereinabove as long as the various contrasting surfaces were generally parallel with each other and with the transverse plane as defined by the longitudinal axes.

In Summary, one features of the invention resides broadly in a multi-section bolted connection, preferably for crane boom parts having a lattice structure, in which for each bolt or bolt pair there is a pair of stops, characterized by the fact that in the upper flange 7 plane of the boom parts 1, 2 positioned for assembly, there is a pair engaged from the rear with bolt 5 and hook-shaped stop 23, and in the lower flange 8 plane, a fork with a strap 4 for a bolt 5.

Another feature of the invention resides broadly in a bolted connection, characterized by the fact that for each stop pair having a hook-shaped stop there is a thrust block 11, 19 or a counter pressure surface 22 corresponding to the hook 9, 14; 23.

Yet another feature of the invention resides broadly in a bolted connection, characterized by the fact that the hook-shaped stop is located on or integrated into the strap 4, 23 and the thrust block 11 or the fork piece 3 and 21 of the bolted connection.

A further feature of the invention resides broadly in a bolted connection, characterized by the integration of the thrust block 20 and hook 14 in the fork 17 or strap 15, with an externally aligned configuration (FIG. 5).

A yet further feature of the invention resides broadly in a bolted connection, characterized by two stop pairs in the upper flange plane of each boom joint.

Yet another further feature of the invention is a bolted connection, characterized by the fact that in addition, there is at least one stop pair (surface stop) consisting of two plane surfaces 12, 13.

An additional feature of the invention resides broadly in a bolted connection, characterized by two hook stops in the upper flange plane and two surface stops in the lower flange plane of each boom joint.

A yet additional feature of the invention resides broadly in a bolted connection, characterized by the fact that there are only hook stops in both flange levels.

A further additional feature of the invention resides broadly in a bolted connection, characterized by the fact that the hook or hooks 9, 14, 23 of each pair of stops are on the corresponding strap 4, 15, or are formed from the latter 23.

A yet further additional feature of the invention resides broadly in a bolted connection, characterized by the fact that the one surface of each surface stop is formed by a bevel 12 on the end of the strap 4 and the other surface 13 is located in the base of the fork 3.

Another further additional feature of the invention resides broadly in a bolted connection, characterized by the fact that the hook or hooks 23 of each pair of stops is or are deformed on the end into a stop contact surface 24.

A yet another additional feature of the invention resides broadly in a bolted connection, characterized by the fact that the stop contact surface 24, when assembled, runs essentially vertically and is in plane contact with the corresponding counterpressure surface 22 in the base of the fork 21.

Another yet further feature of the invention resides broadly in a bolted connection, characterized by the fact that the flat counterpressure surface 22 changes as it proceeds away from the center of the boom into a concave surface 27, the curvature of which matches the external contour of the corresponding hook 23, which surface 27, when assembled, is in close-fitting contact with the outside surface 27*a* of the hook end.

A still further feature of the invention resides broadly in a bolted connection, characterized by the fact that the hooks 23, when assembled, point with their opening away from the center 26 of the boom.

A still further additional feature of the invention resides broadly in a bolted connection, characterized by the fact that the hooks 23, when assembled, surround the corresponding bolts 5 by an angle between 90 degrees and 180 degrees.

Another still further additional feature of the invention resides broadly in a bolted connection, characterized by the fact that the hooks 23, when assembled, and when located in the top flange plane surround the bolt 5 on the side facing the counterpressure surface 22 to above its horizontal diameter, and when located in the lower flange plane, to below its horizontal diameter.

All, or substantially all, of the components and methods of the various embodiments may be used with at least one embodiment or all of the embodiments, is any, described herein.

All of the patents, patent applications and publications recite herein, if any, are hereby incorporated by reference as if set forth in their entirety herein.

The invention as described hereinabove in the context of a preferred embodiment is not to be taken as limited to all of the provided details thereof, since modifications and variations thereof may by made without departing from the spirit and scope of the invention.

What is claimed is:

1. Apparatus for interconnecting crane boom sections, said crane boom sections comprising a first boom section and a second boom section, each of said first and second boom sections having a substantially central longitudinal axis, and each of said first and second boom sections comprising at least one lower elongated member and at least one upper elongated member spaced from said lower elongated member, means connecting at least a portion of said upper and lower elongated members in a substantially parallel configuration, said apparatus for interconnecting being operable to effectively transmit a force between said lower members of said first and second boom sections and another force between said upper members of said first and second boom sections, said apparatus for interconnecting comprising:

a hook-shaped member provided on said upper elongated member of said first boom section;

said hook-shaped member having a lip portion, said lip portion projecting outwardly from said substantially central axis of said first boom section to form a concave depression, said concave depression being concave inwardly toward said substantially central axis of said first boom section;

a bolt member attached to said upper elongated member of said second boom section, said bolt member having a longitudinal axis which is disposed substantially perpendicular to said substantially central longitudinal axis of said second boom section, said bolt member being dimensioned and configured to be received within said concave depression formed by said lip of said hook-shaped member provided on said upper elongated member of said first boom section;

a fork member provided on said at least one upper elongated member of said second boom section, said fork member having at least a pair of extending flange portions, said pair of extending flange portions being spaced from one another to form an open space therebetween, wherein said bolt member extends between said pair of extending flange portions and across said open space therebetween, and wherein said hook-shaped member provided on said upper elongated member of said first boom section is dimensioned and configured to be disposed between said pair of extending flange members;

a first upper abutment surface formed on an outermost extremity of said hook-shaped member, and a second upper abutment surface disposed between said pair of extending flange portions of said fork member;

said first and second upper abutment surfaces being substantially planar surfaces aligned substantially perpendicularly to said substantially central longitudinal axes of said first and second boom sections, respectively;

lower connection means for connecting said lower elongated members of said first and second boom sections together and for transmitting said force therebetween; and at least one of said at least one lower elongated members of said first and second boom sections comprising at least one strap member, and the other of said at least one lower elongated members of said first and second boom sections comprising a fork member, said fork member having at least a pair of extending flange portions, said pair of extending flange portions being spaced from one another to form an open space therebetween, and wherein said strap member is dimensioned and configured to be disposed in said open space between said pair of extending flange members upon interconnection of said first and second boom sections.

* * * * *

UNITED STATES PATENT AND TRADEMARK OFFICE

CERTIFICATE OF CORRECTION

PATENT NO. : 5,082,128

DATED : January 21, 1992

INVENTOR(S) : Hermann FRANZEN, Walter KÖLLNER, Dieter KLEISSINGER, Joachim KRÖLL

It is certified that error appears in the above-identified patent and that said Letters Patent is hereby corrected as shown below:

On the Title page, item [75] under the Inventors section, line 2, delete "Mönchen-Gladbach" and insert --Mönchengladbach--.

In column 3, line 50, after 'FIG.', delete "1" and insert --1a--.

In column 3, line 53, after 'FIG.', delete "1a" and insert --1--.

Signed and Sealed this

Ninth Day of November, 1993

*Attest:*

*Attesting Officer*

BRUCE LEHMAN

*Commissioner of Patents and Trademarks*